US006571406B2

(12) United States Patent
Gerloff

(10) Patent No.: US 6,571,406 B2
(45) Date of Patent: Jun. 3, 2003

(54) SUPPORTING BODY FOR A SHOWER TUB

(76) Inventor: Michael Gerloff, Schwarzer Weg 4, Eschwege (DE), D-27269

( * ) Notice: Subject to any disclaimer, the term of this patent is extended or adjusted under 35 U.S.C. 154(b) by 0 days.

(21) Appl. No.: 10/011,577

(22) Filed: Dec. 3, 2001

(65) Prior Publication Data

US 2002/0066140 A1 Jun. 6, 2002

Related U.S. Application Data

(63) Continuation-in-part of application No. 09/855,219, filed on May 16, 2001.

(30) Foreign Application Priority Data

Dec. 2, 2000 (DE) ..... 100 59 982

(51) Int. Cl.[7] ..... A47K 3/00
(52) U.S. Cl. ..... 4/613; 52/34
(58) Field of Search ..... 4/612, 613, 614; 52/34, 35

(56) References Cited

U.S. PATENT DOCUMENTS

| | | | | | |
|---|---|---|---|---|---|
| 3,501,879 | A | * | 3/1970 | Mitchell et al. | |
| 3,551,918 | A | * | 1/1971 | Bergmark | 4/613 |
| 4,198,715 | A | * | 4/1980 | Daniels | |
| 4,557,004 | A | * | 12/1985 | Piana | 4/613 |
| 5,718,008 | A | * | 2/1998 | Pane | 4/613 |
| 6,014,780 | A | * | 1/2000 | Jurek et al. | 4/613 |
| 6,240,578 | B1 | * | 6/2001 | Planella | 4/612 |
| 6,381,773 | B1 | * | 5/2002 | McAllister | 4/613 |

FOREIGN PATENT DOCUMENTS

| | | | | |
|---|---|---|---|---|
| GB | 1590791 | * | 6/1981 | 4/613 |
| GB | 2108382 | * | 5/1983 | 4/613 |

* cited by examiner

*Primary Examiner*—Charles R. Eloshway
(74) *Attorney, Agent, or Firm*—Thomas R. Vigil; Welsh & Katz, Ltd.

(57) ABSTRACT

Supporting body (1) being part of a shower tub made of stone, tiles or artificial stone and comprising at least one landing (2) that is surrounded by a margin (6), a channel (3) discharging into a drain (4).

19 Claims, 4 Drawing Sheets

SUPPORTING BODY FOR A SHOWER TUB

CROSS-REFERENCE TO RELATED APPLICATIONS

This application is a Continuation-In-Part of U.S. patent application Ser. No. 09/855,219 filed May 16, 2001, which application claims priority from German Patent Application No. 100 59 982.6 filed Dec. 2, 2000.

BACKGROUND OF THE INVENTION

1. Field of the Invention

The invention relates to a supporting body which is part of a shower tub made from stone, tiles or the like.

A shower tub designates the element which constitutes the directly visible portion of the lower part of a shower bath or, in other words, that portion that comes into direct contact with the water.

The present invention is directed to providing a supporting body for the shower tub on one side and the shower tub itself on the other, the supporting body constituting the substructure thereof.

2. Description of the Prior Art

The most various kinds of shower tubs or shower baths have been previously proposed. In particular shower tubs made from synthetic material or glassed steel have become known. Such shower tubs can either be inserted at ground level, i.e., be flush with the surface of the lime floor or they can be mounted onto the lime floor, i.e., the shower bath is mounted onto the lime floor by means of standards for example, still another possibility consisting in providing a so-called medium-high installation in which the shower bath is at least partially sunken in the floor.

The British Patent 1 590 791 discloses a shower tub with a raised ribbed floor.

U.S. Pat. No. 3,551,918 describes a similar construction in which the gutter is merely deeper than in the British Patent 1 590 791.

U.S. Pat. No. 5,718,008 describes a shower tub with a floor provided with individual gutters that discharge into a channel that is partially covered by the floor.

The German Patent DE 298 081 29 U1 discloses a frame with a surrounding gutter. The shower tub rests on the frame. The shower tub is drained by a drain arranged in the shower tub. The gutter formed by the frame lets off both the water impinging laterally onto the tiled floor adjacent the shower tub and the water leaking through the joints underneath the tiles onto the insulation.

The German Patent DE 242 30 083 C2 discloses a support for a shower tub, the support being designed in such a manner that it is capable of receiving shower tubs with differential mounting depths. This is more specifically achieved in placing little blocks underneath when the support is not high enough or in removing material from the base of the support when it is not deep enough.

The French Patent No. 2 562 409 A1 discloses the structure of a shower tub that is provided with an annular gutter serving as a supporting body, a floor tile resting on the upper side of the inner wall of the gutter. Another plate, whose dimensions correspond to the inner free space defined by the gutter, is arranged underneath the floor tile in order to prevent the floor tile from being shifted. Between the floor tile and the outer wall of the gutter there is provided a spacing in order to permit the water to flow from the floor tile into the gutter.

The disadvantage thereof is that, in the center of the construction, the floor tile rests on a hollow space. If the floor tile were not reinforced in this area by the underlying plate, it would be prone to break when provided with a corresponding horizontal extension and submitted to a corresponding load. Another drawback is that, due to the spacing between the floor tile and the external wall of the gutter, said gutter and the dirt it carries are visible from the top.

The post-published WO 01/49157 (U.S. Pat. No. 6,240,578) discloses a widening gutter, a floor tile resting on the inner brims of said gutter. The bottom of the gutter is inclined inward but has no gradient oriented toward the drain. Accordingly, residual water always remains in the gutter, which in the end leads to an unpleasant odor and nuisance to the user. Another disadvantage is that the gutter is very wide, the floor plate overhanging largely on its borders as a result thereof. This involves the risk that the floor tile cants when a person comes to stand on its edge. Still another drawback is that the surrounding gutter as such does not constitute a supporting body stable enough to be capable of standing on its own; the stability of the gutter is only achieved by the fact that it is set in concrete.

The British Patent 2 108 382 discloses a shower tub in the form of a surrounding gutter whose bottom is designed as a removable cover that permits to reach the drain provided in the bottom. Again, this construction is only stable when the shower tub is set in concrete.

In high-quality baths and showers in particular, shower tubs made from stone, more specifically from natural stone or tiles, have additionally become known. They usually have a floor drain in their center. In order to make sure that the shower water reaches the drain, the paving stones or tiles have to be placed in such a manner that on each side a slope toward the drain is provided. With a quadrangular shower tub or shower bath that has a total of four paving stones directed toward the drain, any and all paving stones have another gradient. The manufacturing of such shower tubs requires considerable manual skill. As opposed to the prefabricated shower baths or shower tubs made from glassed steel or synthetic material, such shower tubs of stone, natural stone or tiles are never absolutely watertight on account of the joints. It is therefore absolutely necessary to provide an isolation underneath the shower tub, said isolation being also connected to the drain in such a manner that water passing through the joints can reach the drain on the isolation.

In hotels, in particular where there are suspended ceilings, there is not provided one isolation only, but for safety reasons, two isolations are arranged above each other in order to prevent water from passing through the ceiling when one isolation is damaged. The connection of the isolation to the drain in particular is quite a problem and demands more care from the skilled worker.

It has furthermore been known from the state of the art to use so-called supporting elements made of high-resistance foam which are milled from blocks. These elements, when they are quadrangular in shape, are inclined on all the four sides toward the drain in the center. The disadvantage thereof is that on one side it is complicated to cover such a supporting element with paving stones or tiles, since the paving stones or the tiles respectively have to be cut to size in a very accurate manner in order to obtain a neatly designed shower tub. Another problem is the installation. A such type supporting element of high-resistance foam needs to be bedded accordingly, so that the shower tub as a whole be accommodated solidly. For this purpose, there is provided that such a supporting element made of high-resistance foam be first placed upon bases in order to align the supporting element, said supporting element being bedded with mortar or high-resistance foam in a second stage.

With all the prior art shower tubs, mounting is very complicated, which is true to the same extent for dismantling, and all of them are not substantially tight on account of the pattern of the joints.

SUMMARY OF THE INVENTION

It is therefor the object of the invention to provide a shower tub of the type mentioned herein above, more specifically for natural stone, artificial stone, tiles and the like, that allows easy mounting and dismantling, is perfectly tight and that furthermore permits its installation above ground, at floor level and partially sunken alike.

According to the invention the solution to this object is to provide the supporting body for the shower tub with at least one landing which is surrounded by a margin, a channel being provided that discharges into the drain. The supporting body is designed as a self-standing structure; accordingly, it is not necessary to line the supporting body with concrete in order for the latter to be capable of adopting a stable position as it is the case with the prior art devices. Thanks to the edge that stands on the ground and the landing in particular the supporting body constitutes an inherently stable structure.

The channel, which is set off the upper side of the landing in downward direction, constitutes, in connection with the drain, a water course system that is integrated into the supporting body. This means that in selecting such a construction for the supporting body, a shower tub is provided that has the same advantages with regard to tightness as a conventional shower tub made from synthetic material or glassed steel while still having the optic advantages of a shower tub made, e.g., from natural stone or tiles. Accordingly, the supporting body is part of the shower tub in as much as the supporting body allows the water to drain off. Another advantage over French Pat. No. 2 562 409 appears here. In order to provide a seal between floor tile and gutter, the floor tile should be glued to the gutter. In this case however, the gutter of the shower tub cannot be inspected with reasonable expenditure. However, the gutter must be inspectable when it needs to be cleaned or when objects have fallen there into.

Further advantageous features of possible embodiments will become apparent in the subordinate claims.

There is more particularly provided that the channel specifically surrounds the landing like a ring between the margin of the supporting body and the landing. This makes it possible to cover the landing with a continuous floor tile made of natural or artificial stone, a slot being provided on the border region of the floor tile facing the margin of the supporting body, through which the water may flow into the channel surrounding the landing. This means that, by connecting the supporting body made from synthetic material for example, and here more specifically from polyurethane, to the natural stone cover, a virtually closed system is formed that ensures absolute tightness. The capacity of water absorption is particularly considerable when the channel is annular in shape. Since the drain is covered by the floor tile, it is moreover possible to have a relatively large drain designed without thereby destroying the appearance of the shower tub. Since the continuous plate of natural stone is merely placed upon the landing, complicated mounting works, as they are particularly required according to the state of the art when the paving stones or the tiles have to be installed in such a manner that they are inclined to the centrical drain in four planes, are no longer necessary. So far, joints are avoided as well, which is an optic advantage in particular since the pattern of the joints at least disrupts the appearance of the natural stone.

In order to make certain that the floor tile consisting of natural stone rests safely on the upper side of the landing, said landing is provided on its upper side with knobs. In a mating manner, the paving stone is provided on its underside with corresponding recesses or pocket holes.

Since the lateral extension of the channel is small, the overhang of the floor plate is so small that the plate cannot cant. Furthermore, as a result of the relatively small section of the channel, the flow velocity is high, which prevents dirt from depositing in the channel.

In order to furthermore make certain that the water that flows into the channel can drain off, the channel is inclined toward the drain.

According to another particular feature of the invention, the supporting body has several recesses on its underside in the region of the drain, a rib being provided between the discrete recesses to advantageously reinforce the supporting body. These recesses provide space for laying the pipes that may be directed from the drain toward a connection point provided for at any place in the wall in this region.

The drain in the supporting body is more particularly surrounded by an annular margin in order to provide the possibility, in connection with the siphon of the drain, of sealing by means of rubber rings. Accordingly, the landing is cut out in the region of the drain. In order to prevent the paving stone in the region of said sparing for the drain from lying bare, a landing standard, which is flush with the landing edges, is provided behind the drain, said standard additionally supporting the paving stone from beneath.

Another object of the invention is a shower tub made from stone, tiles or the like, more specifically with a supporting body of the type described herein above, which is characterized in that at least one floor tile constituting the floor of the shower tub is placed onto the landing, the floor tile forming a slot for allowing the water to drain off toward the channel in the region thereof, said slot being oriented at an angle with respect to the vertical. Thanks to the angular inward orientation of the slot, it is not possible to look into the channel from the top. Furthermore, the floor tile can only be received on account of this configuration. This configuration more specifically gives the optical impression of a continuous surface since, even if one looks into the slot from the top, what can be seen is the material of the margin area or the material of the floor tile e.g., granite, and not the material of the supporting body or the dirt in the channel. More specifically, when the margin is provided with a frame that is flush with the floor plate, the looker on can only see the material of the floor plate or of the margin frame when looking through the slant slot.

Stated more specifically, there is provided that the slot is formed by two paralleled side faces, the lower opening of the slot being laterally offset by at least the width of the upper opening. With the lower opening being offset relative to the upper opening, it is not possible to look through the slot which is advantageously contouring.

This makes particularly obvious the ease of mounting of the overall shower tub. The supporting body is a prefabricated element made from a synthetic material, more specifically from polyurethane foam, the margin being first covered with a surrounding layer of natural stone or tiles. After the draining channel and the siphon in the drain are installed and the supporting body is inserted, the only thing that remains to do is to lay the floor tile made from stone. To clean the channel and the siphon respectively, the floor tile only needs to be lifted. As already mentioned herein above, the floor tile rests on knobs arranged on the landing, the floor tile being provided on its underside with a pattern of pocket holes that mates the pattern of knobs on the landing, thus permitting accurate positioning of the floor tile on the landing.

In order to effectively prevent deposits such as mildew or the like from forming as a result of humidity on the underside of the floor tile made of natural or artificial stone, said underside is provided with a waterproof seal such as a polyester resin coating for example.

The invention will be explained in greater detail in the following with the help of the drawings illustrating an example thereof.

DESCRIPTION OF THE PREFERRED EMBODIMENT (S)

Figure 1:
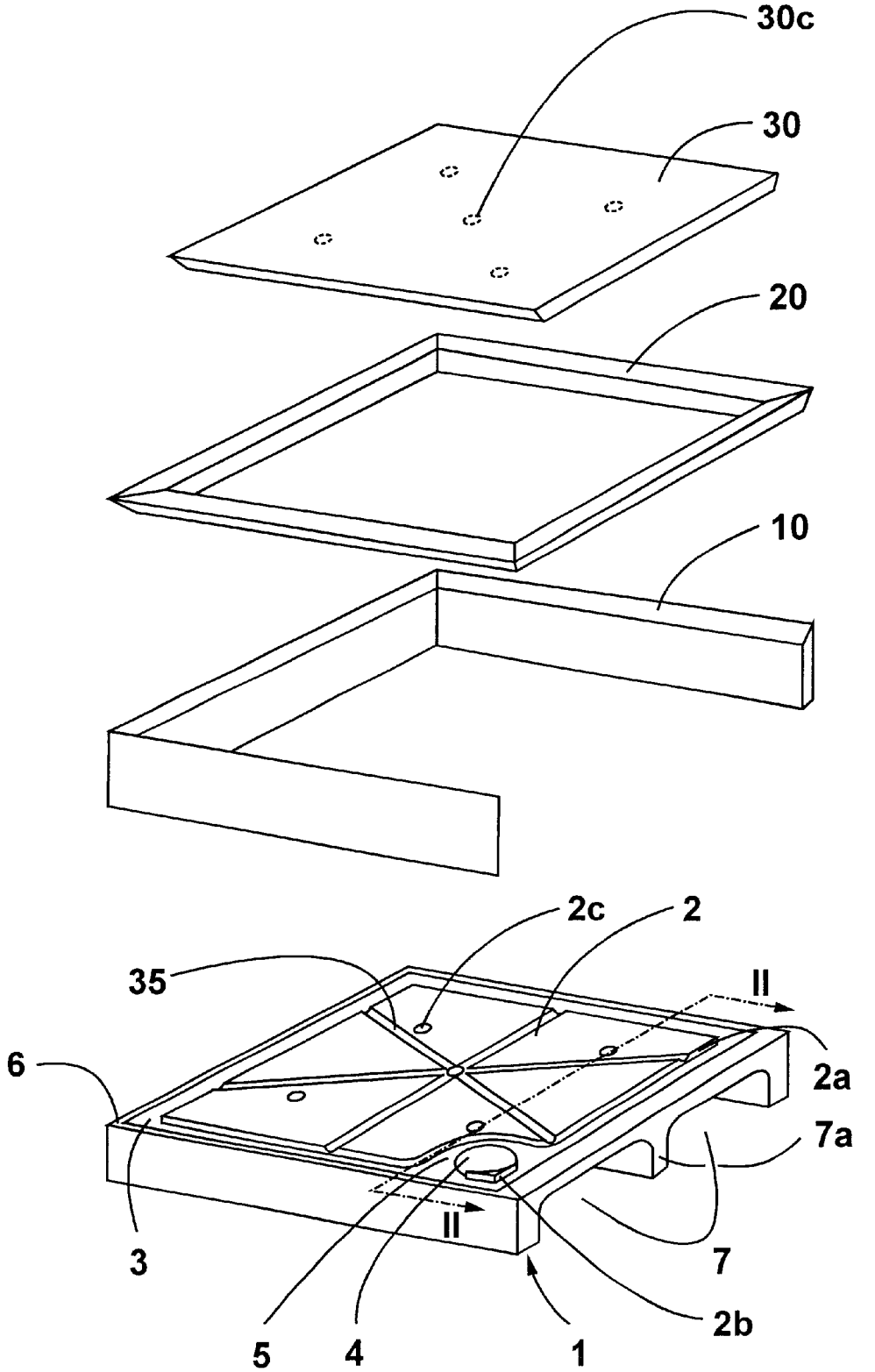
FIG. 1 is an exploded perspective view of the structure of the shower tub with a supporting body.

The structure of an overall shower tub with or on the supporting body 1 respectively can be surveyed—as already mentioned—from FIG. 1. The supporting body 1 rests on or in the lime floor 50 and abuts the wall 60. FIG. 1 shows the supporting body indicated at 1 whose margin 6 is covered by a margin border 10, wherein a margin frame 20 can be placed onto the margin border 10, the margin frame 20 framing the floor tile 30 resting on the landing 2 of the supporting body 1. Accordingly, the shower tub itself is substantially mounted onto the supporting body or onto the margin thereof respectively. An annular channel 3, which is inclined toward the drain 4, surrounds the landing 2. The drain 4 is provided with a marginal region 5 that is stepped downward with respect to the landing 2, said marginal region forming around the drain an annular area that serves to receive sealing means such as O rings for example. Accordingly, the supporting body is inasmuch a component part of the shower tub as it serves to drain the water by way of the channel.

Extending in longitudinal direction from the side edges 2*a* of the landing 2, there is provided a so-called landing standard 2*b*, the upper side of which is placed at the same height as the landing 2. The landing 2 is moreover provided with knobs 2*c* engaging into corresponding pocket holes 30*c* of the floor tile 30, thus ensuring stable seating of the floor tile 30 on the landing 2.

The margin indicated at 6 of the supporting body 1 is located around the annular channel and is reveted—as already mentioned above—by the margin border 10 and the margin frame 20.

Two recesses 7 are provided in the region of the drain 4, the recesses 7 being separated by a rib 7*a* that serves to reinforce the supporting body in this region. The recesses 7 are intended to facilitate the laying of the drain pipes in direction of the sewage pipe.

Figure 2:
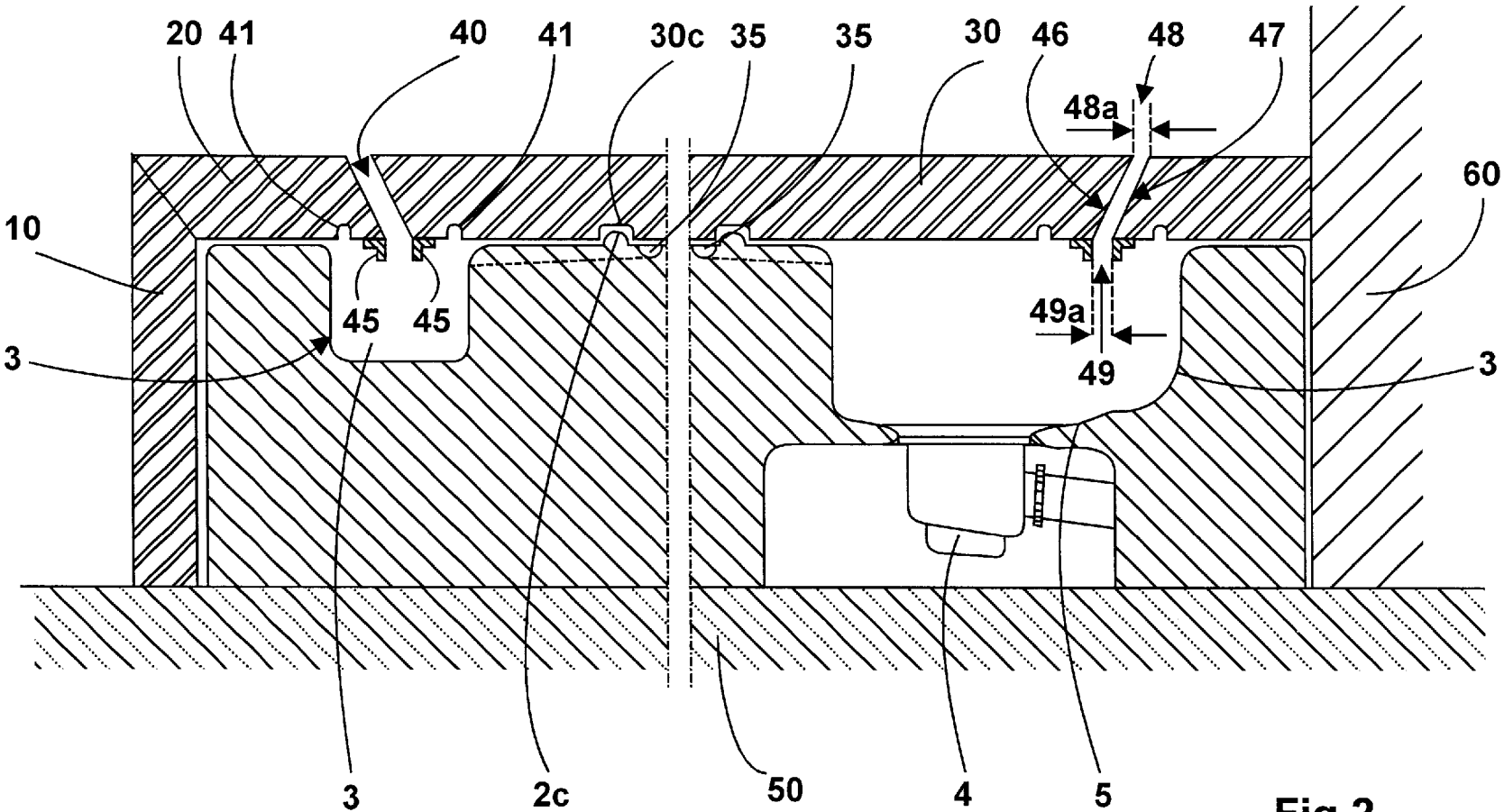
FIG. 2 is a section along the line II—II of FIG. 1, installation being carried out on the lime floor.
Figure 3:
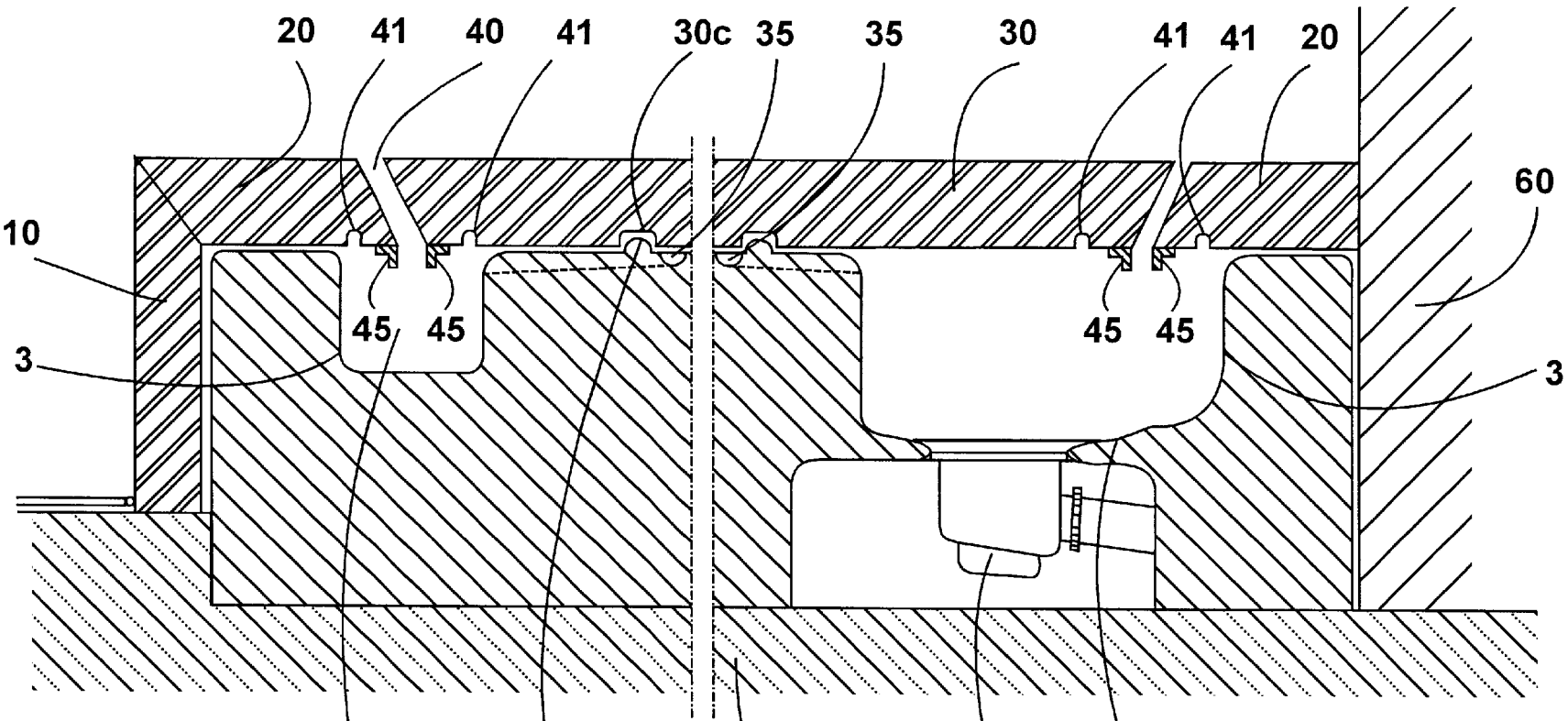
FIG. 3 is an insertion, the supporting body being partially sunken in the lime floor.
Figure 4:
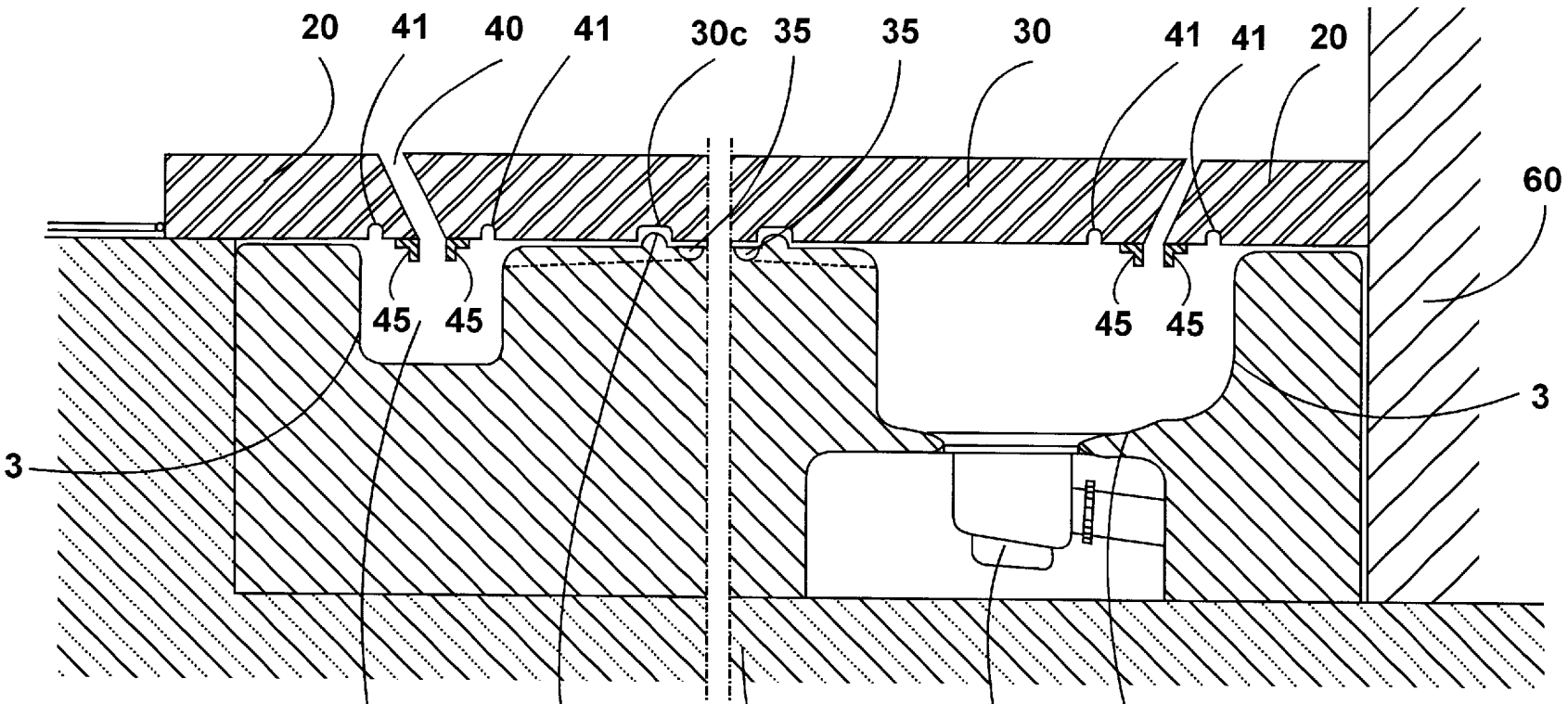
FIG. 4 shows installation at floor level.

FIG. 2 shows the overall shower tub in detail; it can particularly be surveyed from FIG. 2 that above the annular channel 3 the floor tile 30 is provided with a slot 40 on its side facing the margin frame 20, said slot allowing the water to drain off into the channel 3. The surrounding slot 40 has two paralleled side faces 46, 47 with an upper opening 48 and a lower opening 49, each of said openings having one opening side 48*a* and 49*a*. The inclination of the slot 40 is such that the two openings 48, 49 do not overlap but that the lower opening is laterally offset by at least the width 48*a* of the upper opening 48. As a result thereof, it is not possible to look into the channel 3 although inspectability is ensured by the way the floor tile is received. Surrounding drip grooves 31 and 21 respectively are furthermore provided in the region of the slot 40 in order to prevent the water from flowing alongside the underside of the floor tile 30 or alongside the underside of the margin frame 20 respectively.

According to a first variant and in order to prevent water that is discharged through the slot 40 from infiltrating by capillary forces under the floor tile 30 or into the space between floor tile 30 and supporting body 1, there is provided, on either side of the slot 40, the surrounding groove 41. Alternatively, there is provided in the area of the slot 40 of floor tile 30 a water-repellent strip 45 that is L-shaped for example and is made of an elastomer or the like. This strip, with a preferably L-shaped cross-section, extends alongside slot 40, preferably on either side of the slot.

Under certain conditions, condensation water proved to form underneath the floor tile 30 in the area of the landing 2. On the upper side of the supporting body 1, gutters 35 for discharging said condensation water are provided, said gutters extending radially and declining from the center of the landing 2 of the supporting body toward the channel 3. Furthermore, the gutters 35 aerate the space between floor tile and landing of the supporting body.

Mounting is carried out in that the prefabricated supporting body made from polyurethane foam for example is first temporarily placed on the lime floor or, in case the shower tub is desired to lie flush with the floor, into the lime floor. Then, the shape of the supporting body is marked on the lime floor or on the floor. After sewering is performed, the supporting body is positioned into or onto the lime floor depending on the installation variant desired. After the siphon is connected to the sewer, the margin border 10 is accommodated or the margin frame 20 only is positioned when, according to the one variant, the shower tub is installed at floor level, wherein, as a concluding step, the floor tile 30 alone needs to be placed. It is possible to have the revetment of the supporting body already previously mounted in the factory, depending on the installation variant to be carried out.

The advantage of this construction of a shower tub with supporting body lies in its ease of installation or dismantling and in the absolute water tightness. The shower tub furthermore has an aesthetic shape and can be covered with any material whatever.

I claim:

1. A supporting body (1) as part of a shower tub made from stone or tile, said supporting body (1) being located beneath a shower floor (30) and having at least one upper landing (2) which is surrounded by a margin (6), a channel (3) being provided in the landing (2) that discharges into a drain (4) and the landing (2) being provided with gutters (35) that extend and decline from the center of the landing (2) toward the channel (3), and the supporting body (1) being configured as a stable, self-standing, box-type structure.

2. The supporting body (1) for a shower tub as defined in claim 1, charaterized in that the channel (3) is provided between the margin (6) and the landing (2) of the supporting body (1).

3. The supporting body (1) for a shower tub as defined in claim 2, characterized in that the channel (3) surrounds the landing (2) like a ring.

4. The supporting body (1) for a shower tub as defined in claim 2, characterized in that the channel (3) is inclined toward the drain (4).

5. The supporting body (1) for a shower tub as defined in claim 1, characterized in that the landing (2) is provided with knobs **(2*c*)** on its upper side.

6. The supporting body (1) for a shower tub as defined in claim 1, characterized in that the supporting body (1) is provided with recesses (7) on the underside of the supporting body (1) in the region of the drain (4).

7. The supporting body (1) for a shower tub as defined in claim 6, characterized in that two recesses (7) are provided between which a rib **(7*a*) is arranged to reinforce the supporting body (1)**.

8. The supporting body (1) for a shower tub as defined in claim 1, characterized in that the drain (4) is surrounded by an annular marginal region (5).

9. The supporting body (1) for a shower tub as defined in claim 1, characterized in that the landing (2) is cut out in the region of the drain (4).

10. The supporting body (1) for a shower tub as defined in claim 9, characterized in that a landing standard **(2*b*) is provided behind the drain (4) in true alignment with the landing edges (2*a*)**.

11. A shower tub made from stone, tiles or plastics, more specifically with a supporting body (1) with at least one landing (2) that is surrounded by a margin (6), a channel (3) being provided that discharges into a drain (4), at least one floor tile (30), which forms the floor of the shower tub receivably resting on the landing (2), a slot (40) for draining the water toward channel (3) being provided in the area of the channel (3) between floor tile (30) and the margin, said slot (40) being oriented angularly with respect to the vertical.

12. The shower tub as defined in claim 11, characterized in that the margin (6) of the supporting body (1) is reveted with stones, tiles or artificial stone.

13. The shower tub as defined in claim 11, characterized in that for revetment, the margin (6) is provided with a margin frame (20), the slot (40) being formed between margin frame (20) and floor tile (30).

14. The shower tub as defined in claim 11, characterized in that the floor tile (30) is provided on its underside with pocket holes **(30*c*) and with mating knobs (2*c*) that are arranged on the upper side of the landing (2)**.

15. The shower tub as defined in claim 11, characterized in that the underside of the floor tile (30) is provided with a waterproof seal.

16. The shower tub as defined in claim 11, characterized in that there are provided, on the underside of the floor tile (30), means (41, 45) that prevent water from infiltrating along the underside of the floor tile (30).

17. The shower tub as defined in claim 16, characterized in that the means (41, 45) is a water-repellent strip that is more specifically L-shaped.

18. The shower tub as defined in claim 11, characterized in that the slot (40) is formed by two paralleled side faces (46, 47), the lower opening (49) of the slot (40) being laterally offset by at least the width **(48*a*) of the upper opening (48)**.

19. The shower tub as defined in claim 11, characterized in that the slot (40) surrounds the landing (2).

* * * * *